United States Patent [19]

Womack

[11] Patent Number: 5,058,465

[45] Date of Patent: Oct. 22, 1991

[54] KEY HOLDING TOOL FOR IMPRESSIONING

[76] Inventor: Robert C. Womack, P.O. Box 35027, Dallas, Tex. 75235

[21] Appl. No.: 348,873

[22] Filed: May 8, 1989

[51] Int. Cl.[5] ..... B25H 3/00

[52] U.S. Cl. ..... 81/487; 81/418; 81/177.4; 81/438

[58] Field of Search ..... 81/487 R, 418, 177.4, 81/490, 129, 438, 451, 125

[56] References Cited

U.S. PATENT DOCUMENTS

| | | | |
|---|---|---|---|
| 855,280 | 5/1907 | Campbell | 81/438 |
| 1,427,668 | 8/1922 | Williams | 81/418 |
| 1,935,748 | 11/1933 | Roff | 81/438 |
| 4,384,499 | 5/1983 | Shockley | 81/177.4 |
| 4,815,346 | 3/1989 | Littlehorn | 81/177.4 |

FOREIGN PATENT DOCUMENTS

| | | | |
|---|---|---|---|
| 0914262 | 3/1982 | U.S.S.R. | 81/487 |

*Primary Examiner*—Frederick R. Schmidt
*Assistant Examiner*—Lawrence Cruz
*Attorney, Agent, or Firm*—Warren H. Kintzinger

[57] ABSTRACT

A device for holding a lock key firmly while inserting the key in a lock on a building, automobile, filing cabinet or other. The purpose of the tool is to impart torque simultaneous with a rocking motion to the key. This causes marks to be made on the key by the lock pins or wafers and shows the locksmith where to file the key to make it open the lock. This procedure is well known to those in the locksmith's trade, and is called impressioning.

4 Claims, 2 Drawing Sheets

KEY HOLDING TOOL FOR IMPRESSIONING

BACKGROUND AND SUMMARY OF THE INVENTION

This invention relates to a device to hold a lock key firmly while impressioning, and the need for this invention is evidenced by the fact that most locksmiths use locking type pliers to hold the key while impressioning.

Other methods used to hold a key while impressioning are either too bulky or will let the key slip in the process. While locking type pliers will work; they are not on the true centerline of the lock rotating plug, and therefore require much care to prevent key breakage in the process. The locking type pliers also will allow the key to slip in the plier jaws as the rocking motion and torque is applied to the key.

The invention herein described uses two cup point set screws which bite into the key preventing slippage of the key during the impressioning process.

A further object of this invention is that this tool holds and rotates the key on a true centerline of the lock plug giving better feel in the process. Another object of this invention is a convenient friction holder in the tool handle for the hex set screw wrench used for tightening and loosening the cup point screws clamping the key.

Yet another advantage of this invention is that the handle can be injection molded plastic around an aluminum or steel head; making it very strong where the key is clamped and making it easy to manufacture for a reasonable price.

Another feature of this invention is the slim nose on the tool to allow it to enter an automobile steering column ignition lock between the tabs on the lock.

The novel features and advantages of the invention as well as additional objects thereof, will be understood more fully from the following description when read in connection with the drawings.

DRAWINGS

FIG. 1. Perspective view of one form of the tool with a key clamped in the tool jaws.

FIG. 2. Rear perspective view of FIG. 1 showing one method of holding the hex (allen) wrench in the hollow handle; and showing groove for centering hex wrench in tool handle.

FIG. 3. Partial view of an automobile steering column showing the centerline torque and rocking motion imparted to the key when impressioning with the tool. Also shows pointed nose of tool to clear tabs on automobile steering column lock.

FIG. 4. Cut away view showing one possible method of retaining hex wrench in tool handle and showing metal nose insert molded into plastic handle.

DESCRIPTION OF THE EMBODIMENTS

Figure 1:
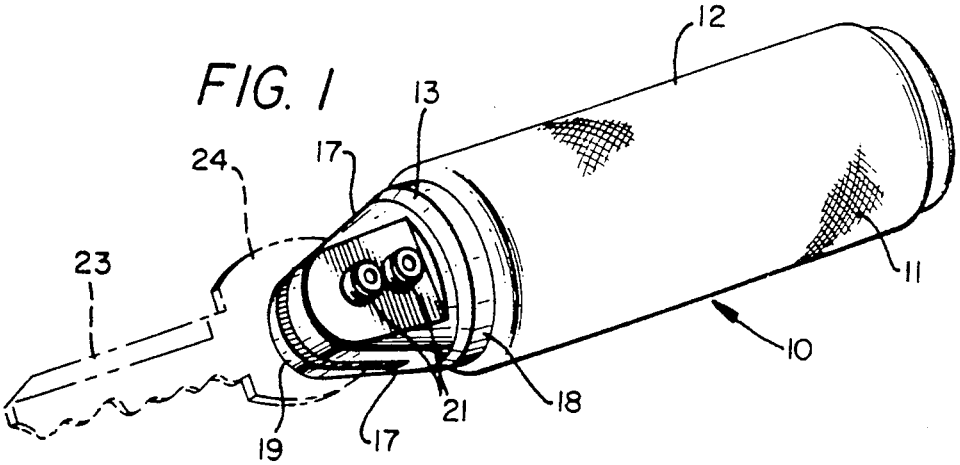

FIG. 1. 1 Is the tool handle with 5 knurl or other rough finish to prevent tool from slipping in the user's hand. 2 is 2 cup point set screws which bite into the head of key 3 to prevent key slipping when tightened.

Figure 2:
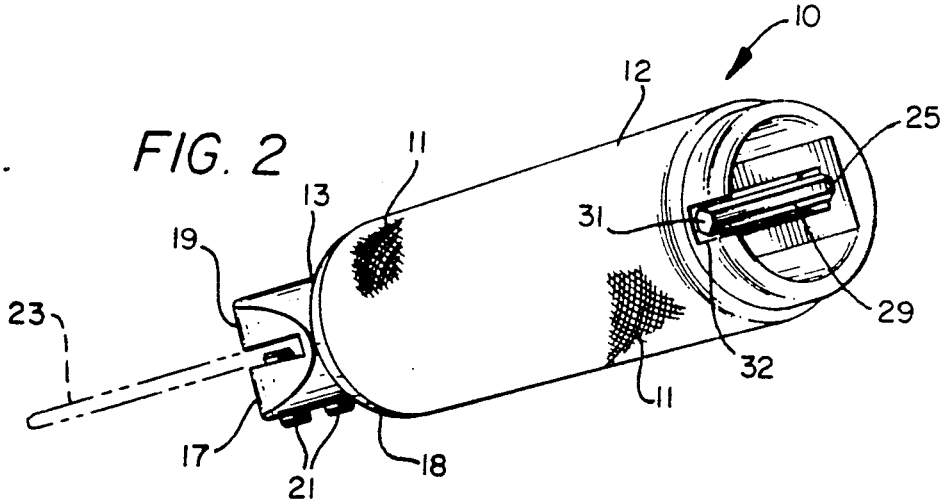

FIG. 2, 1 handle of tool—3 key clamped in tool jaws—4 hex wrench that is used to tighten and loosen screws 2. 5 is knurl or rough surface on handle—6 is notch to hold hex wrench 4 in center of hollow handle 1; for ease of removing wrench 4 with fingers.

Figure 3:
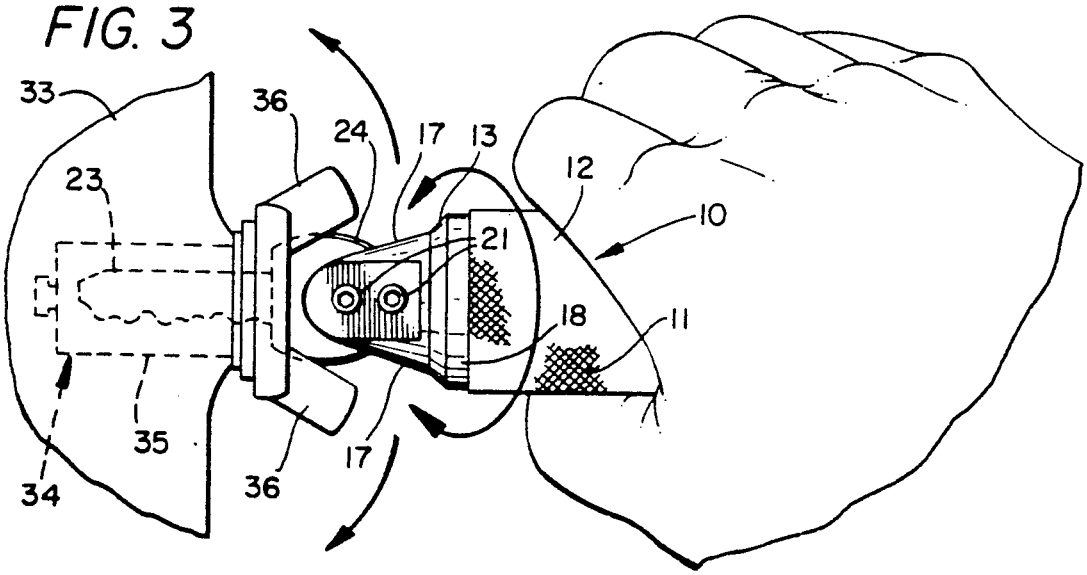

FIG. 3. View showing tool with key 3 clamped in jaws and illustrates how tool nose 10 clears tabs 8 on a partial view of automobile steering column 7 and lock. Also illustrates simultaneous torque and rotary motion imparted to the key on centerline of lock plug 9.

Figure 4:
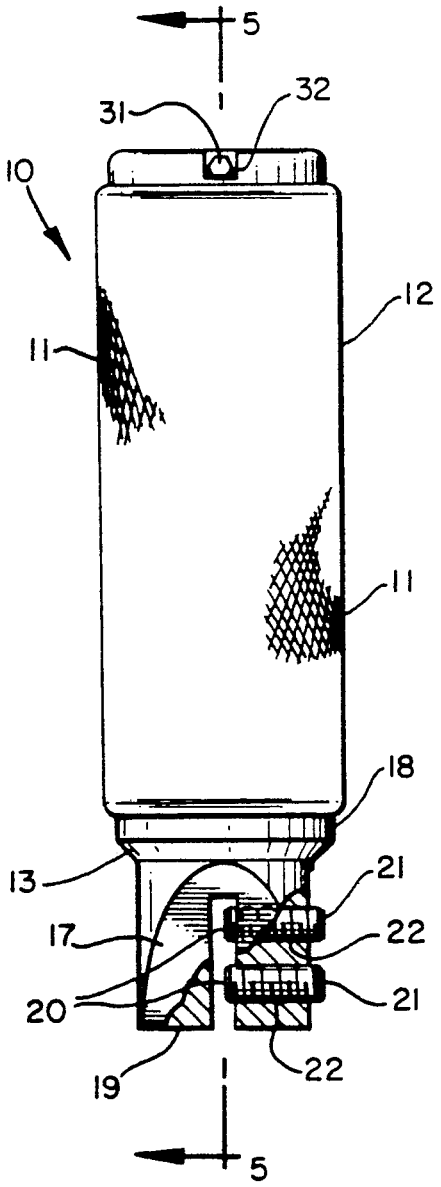
Figure 5:
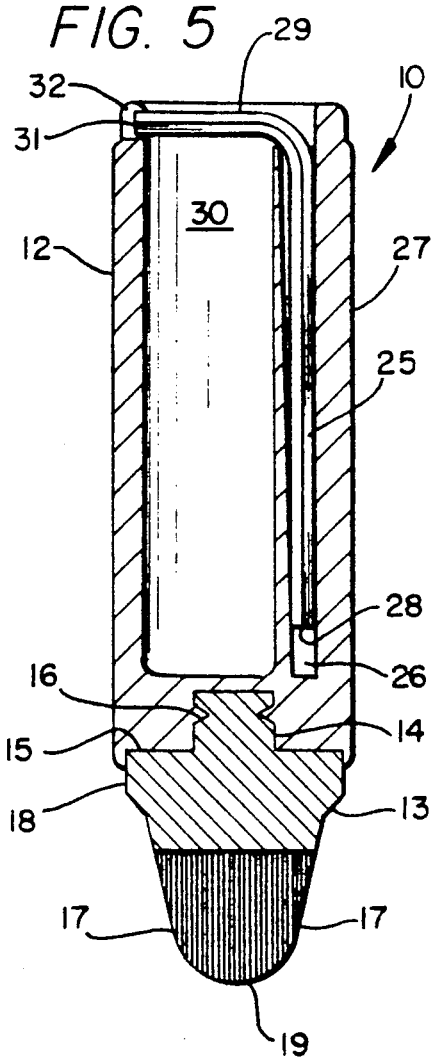

FIG. 4. Section of tool cut on line Y—Y showing steel or other insert of nose 10 molded into handle 1—steel or other material 14 may be chosen for prevention of breaking tool jaw or stripping screws threads 2. Long tapered hole 11 illustrates one way wrench 4 may be held in tapered hole in handle 1—also shows groove to center wrench 4 in handle 1 and stop 12 to prevent wrench 4 from going too deep into handle 1.

I claim:

1. A keyholding tool for key impressioning comprising: a tool having a cross slotted taper sided nose, and handle means sized and shaped for convenient holding by the hand being generally round and mounting said cross slotted taper sided nose on one end; and a plurality of set screws mounted in and extending through one side of said cross slotted taper sided nose for being tightened down to tightly grip the head of a key form inserted and held in said cross slot; wherein said plurality of set screws are cup pointed set screws, when tightened, bits into the head of a key form inserted and held in said cross slot of said cross slotted taper sided nose; said set screws are threadable in and out of threaded openings through said one side of said cross slotted taper sided nose at right angles to the plane of said cross slot through said cross slotted taper sided nose; said handle means is formed internally with an in place friction wedge shaped opening holder for a hex set screw wrench used for tightening and loosening said cup point screws used for clamping key forms; wherein an end of said hex set screw wrench is a press friction hold fit in said wedge opening holder; with said wedge opening holder within a thickened portion of said hollow handle means.

2. The key holding tool for key impressioning of claim 1, wherein said hex set screw wrench is an allen wrench with the shorter head end thereof extended across the hollow body handle opening to a screw engaging and resting in a handle rear end notch when the wrench is stored in place within the hollow handle.

3. The key holding tool for key impressioning of claim 2, wherein said handle is a molded plastic hollow body handle; and said metal nose has a rear projection shaped for positive anchor hold within plastic of said molded plastic hollow body handle.

4. The key holding tool for key impressioning of claim 3, wherein said metal nose is centered substantially on the center line of said handle and holds key forms mounted therein substantially on the centerline of a lock core the key form is inserted into while held by said tool while impressioning movements are transmitted from a hand holding the tool.

* * * * *